US006196090B1

(12) United States Patent
Dumont

(10) Patent No.: US 6,196,090 B1
(45) Date of Patent: Mar. 6, 2001

(54) ONE-WAY DRIVE STRAP WRENCH

(75) Inventor: Bertrand Dumont, Paris (FR)

(73) Assignee: Facom, Morangis (FR)

( * ) Notice: Subject to any disclaimer, the term of this patent is extended or adjusted under 35 U.S.C. 154(b) by 0 days.

(21) Appl. No.: 09/325,018

(22) Filed: Jun. 3, 1999

(30) Foreign Application Priority Data

Jun. 5, 1998 (FR) ..... 98 07108
Oct. 7, 1998 (FR) ..... 98 12577

(51) Int. Cl.[7] ..... B25B 13/52
(52) U.S. Cl. ..... 81/64
(58) Field of Search ..... 81/64, 65, 65.2, 81/68, 69, 70, 3.43

(56) References Cited

U.S. PATENT DOCUMENTS

| | | | | |
|---|---|---|---|---|
| 775,581 | * | 11/1904 | Rothenbucher | 81/69 |
| 1,007,302 | * | 10/1911 | McMullen | 81/69 |
| 1,186,919 | * | 6/1916 | Law | 81/69 |
| 1,659,081 | | 4/1928 | Carnelli et al. . | |
| 1,666,353 | | 4/1928 | Schelf . | |
| 2,566,108 | | 8/1951 | Anderson . | |
| 3,200,676 | * | 8/1965 | Pagel | 81/64 |
| 3,851,548 | * | 12/1974 | Rutz | 81/64 |

FOREIGN PATENT DOCUMENTS

| | | | | |
|---|---|---|---|---|
| 29 10 563 | | 9/1980 | (DE) . | |
| 0 618 045 | | 10/1994 | (EP) . | |
| 1570027 | | 6/1969 | (FR) . | |
| 171184 | * | 11/1921 | (GB) | 81/69 |
| 211136 | * | 2/1925 | (GB) | 81/69 |
| 657308 | | 9/1951 | (GB) . | |
| 2 229 949 | | 10/1990 | (GB) . | |

* cited by examiner

*Primary Examiner*—David A. Scherbel
*Assistant Examiner*—Joni B. Danganan
(74) *Attorney, Agent, or Firm*—Wenderoth, Lind & Ponack, L.L.P.

(57) ABSTRACT

A one-way drive strap wrench having two strand parts (11A, 11B) and a shoe (15) for bearing against an oil filter (2). The shoe is pivotally mounted about a laterally offset axis (16). The wrench is particularly adapted for the fitting and removal of motor vehicle oil filters.

24 Claims, 4 Drawing Sheets

ONE-WAY DRIVE STRAP WRENCH

BACKGROUND OF THE INVENTION

1. Field of the Invention

The present invention relates to a strap wrench for turning an object of cylindrical overall shape in one direction. This type of wrench includes a part forming a handle, and a strap, particularly made of metal, in the form of a loop, the two opposite strand parts of which cooperate with two zones secured to the handle when the strap is wrapped tightly around the object.

The handle is equipped, between the two zones, with a shoe for pressing against the object. The pressing shoe is not connected to the strap and has a bearing face of cylindrical overall shape with its generatrices at right angles to the overall plane of the strap.

The invention applies particularly to oil filter wrenches for motor vehicles and, in what follows, reference will be made to this application.

2. Description of Related Art

Examples of such strap wrenches are described in FR-A-1,570,027 and in EP-A-0,618,045 in the name of the Applicant Company.

In these known strap wrenches, the shoe is secured rigidly to the handle. As a result, when the space available around the oil filter allows the wrench to be turned only by a limited amount, the operator has to perform repetitive manipulations of shortening/lengthening the useful length of the strap, using a knurled knob which forms part of a screw-nut mechanism for adjusting the strap.

SUMMARY OF THE INVENTION

The object of the invention is to make strap wrenches easier to use in a particularly ergonomical way.

To this end, the subject of the invention is a strap wrench of the aforementioned type, characterized in that the shoe is pivot-mounted with respect to the handle so that it can pivot about a geometric axis associated with the handle and at right angles to the overall plane of the strap. This axis is located in such a way that when the shoe and the strap are both clamped tightly against the object, action on the handle exerted in a first direction causes the object to be turned and, exerted in the other direction, causes the shoe and the strap to slip on the object.

BRIEF DESCRIPTION OF THE DRAWINGS

Embodiments of the invention will now be described with reference to the appended drawings, in which.

DETAILED DESCRIPTION OF THE INVENTION

Figure 3:
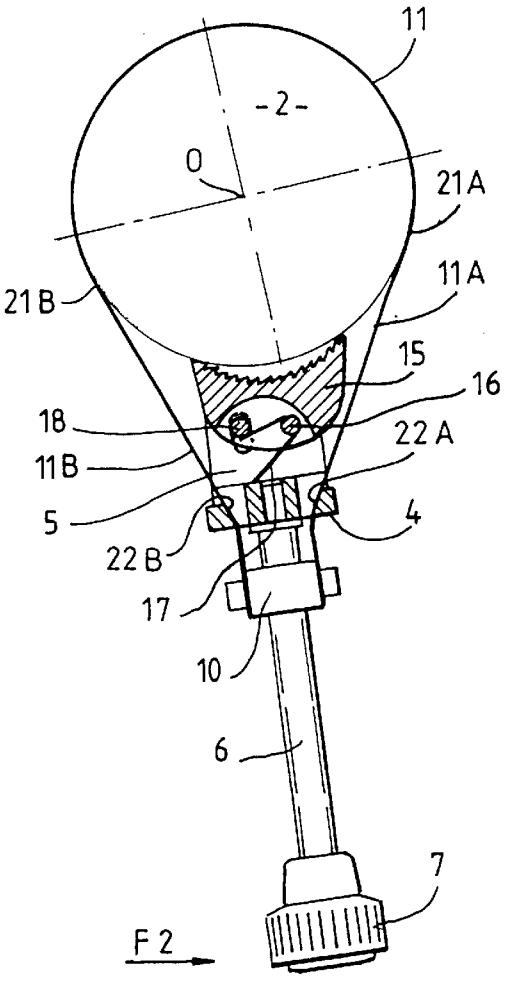
FIG. 3 is a similar view during the first phase of unscrewing the filter.

The strap wrench 1 depicted in FIGS. 1 to 4 is intended mainly for unscrewing and, in addition, by turning the wrench over, for screwing on, objects 2 of cylindrical overall shape, especially oil filters, the diameters of which may vary across a broad range, for example, in the embodiment depicted, from 66 to 96 mm.

To describe the wrench 1 more conveniently, it will be assumed to be oriented as illustrated in the drawings, with the filter 2 with its axis O horizontal and situated above the wrench.

The strap wrench 1 comprises the following:

1) A rigid body 3 which comprises a base 4 from which there extends a yoke 5, the legs of which are parallel to the plane of the drawing.

2) A threaded rod 6 which may be a multiple-start thread, the lower end of which bears a knurled operating knob 7 while its plain and smaller-diameter, upper end 8 rotates in a central hole 9 in the base 4, while being prevented from translational movement in this hole. An example of such an arrangement is described in the aforementioned FR-A-1, 570,027.

3) A nut 10 mounted on the rod 6.

4) A band, especially made of metal, 11, forming a strap, each end part of which passes with a copious amount of clearance through a lateral slot 12 in the base 4 and then, below this slot, is fixed to the nut 10 by means of a screw 13. The strap is guided laterally in each slot 12 which, opposite the other slot 12, has a surface 14 on which the strap can bear. The surfaces 14 diverge in the direction of the object 2 and may be domed. As an alternative, these bearing surfaces could be defined by the peripheral surface of two rollers, as described in the aforementioned French A-publication.

5) A shoe 15, for pressing on the filter 2, is articulated in the yoke 5 about a pin 16 the axis of which bears the same reference numeral. The pin 16 protrudes from the shoe on each side and rotates in two holes formed in the legs of the yoke 5. The shoe is placed freely between the two strand parts of the strap 11.

6) A hairpin spring 17 wound around the pin 16. One end of this spring bears against the upper face of the base 4 and its other end bears under a second pin 18 secured to the shoe 15. The pin 18 protrudes from the shoe on each side thereof, and its ends are housed in arcshaped slots 19 formed made in the legs of the yoke 5. The arc-shaped slots are formed such that the axis of pin 16 is the center.

The upper face 20 of the shoe has a cylindrical overall shape with generatrices at right angles to the mean plane of the strap 11, which is the plane of the drawing. The directrix of the cylinder may be circular, for example of a radius that corresponds to the smallest radius of the filters that are to be manipulated, as depicted, or as an alternative may be in the shape of a very open V. The face 20 is additionally shaped with sawteeth inclined to the right in the figures, in an attempt to gain a grip or purchase on the object 2 in a preferred direction, as will become evident later.

The assembly comprising the body 3 and rod 6 with its knob 7 is symmetric with respect to a plane P, which is parallel to the axis O or at right angles to the mid-plane of the strap, which passes through the axis X—X of the rod 6. The axis 16 is offset to the right with respect to the plane P, and the axis of the pin 18 is offset to the left with respect to this plane.

Thus, at rest (FIG. 1), the spring makes the shoe 15 pivot about the axis 16 in the clockwise direction until the pin 18 comes into abutment against the upper end of the slots 19.

The unscrewing of the filter 2 using the wrench 1 will now be described.

Figure 2:
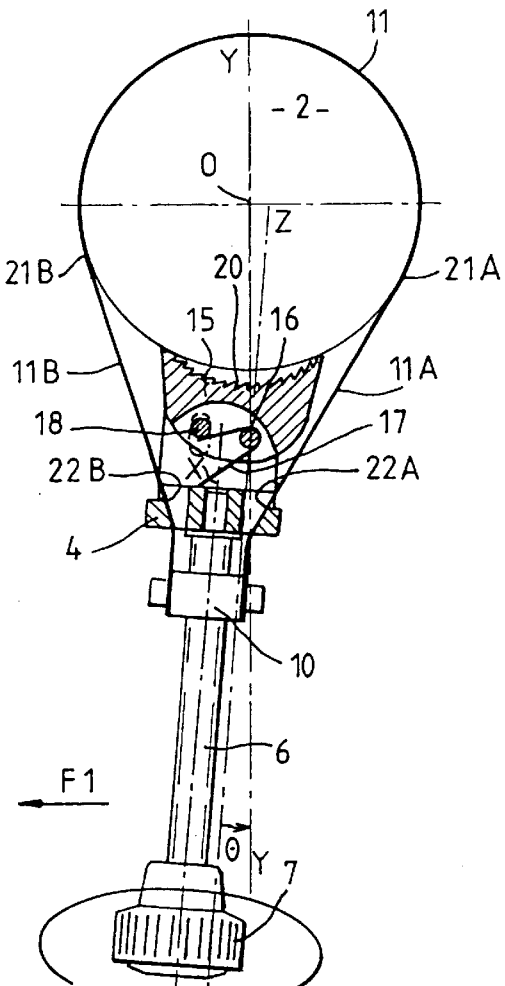
FIG. 2 is a similar view after the strap has been adjusted to fit tightly around the oil filter.
Figure 1:
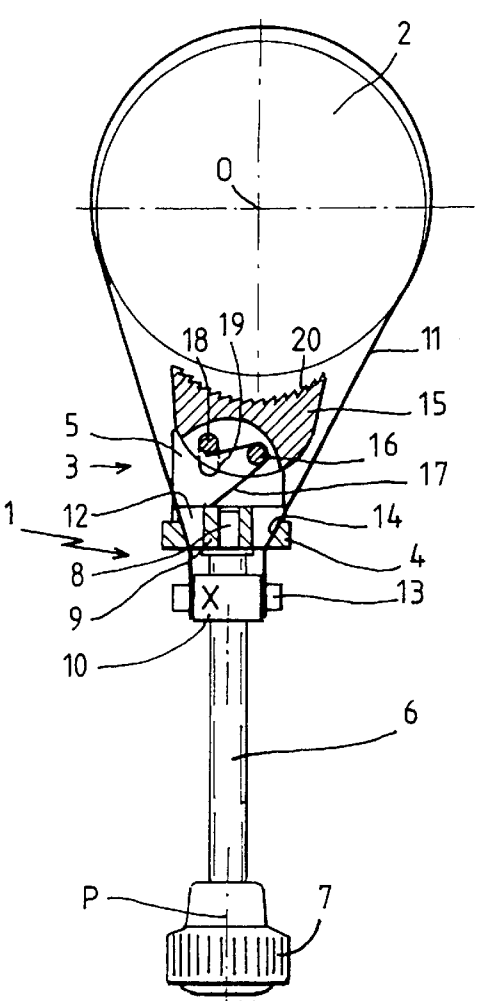
FIG. 1 depicts, in longitudinal section, a strap wrench according to the invention with the strap in position loosely around an oil filter that is to be unscrewed.

The strap is fitted loosely around the filter (FIG. 1) Next, the knob 7 is turned in the clockwise direction (FIG. 2). Because of the lateral guidance of the two strand parts of the strap in the slots 12, this movement causes the nut 10 to descend along the threaded rod, and therefore shortens the useful length of the strap, that is to say its length emerging from the body 3.

When the shoe is pressing against the filter, the strap begins to be tensioned, pressing against the zones 14 of the base 4. Continuing to turn the knob 7 forces the body 3/rod 6 assembly to pivot slightly in the clockwise direction (arrow F1 in FIG. 2) about the axis 16, compressing the spring 17. The pin 18 therefore leaves the upper end of the slots 19.

The operator feels a markedly increased resistance to the turning of the knob 7 as soon as this compression of the spring 17 begins. He can therefore stop operating the knob 7, and the wrench will be in the position of FIG. 2 ready to turn the filter 2. If he nonetheless continues to turn the knob 7, the tension in the strap will be limited by the pin 18 coming into abutment against the lower end of the slots 19.

The strap 11 now has two taut strand parts. One strand part 11A, to the right in FIG. 2, lying between the point 21A where, on this side, the strap leaves the filter 2 at a tangent, and the distal point 22A of its region of contact with the right-hand zone 14A (FIG. 5); and a left-hand strap part 11B, defined in a similar way. The zone 14A lies on the same side as the geometric axis 16 with respect to the axis X—X and the distal end 22A is further from the axis X—X than is the geometric axis 16.

The operator then pushes the rod 6/knob 7 assembly in the counterclockwise direction (arrow F2 in FIG. 3). The sawteeth on the bearing face 20 of the shoe get a firm grip on the filter, and this action causes the wrench and the filter to rotate as one about the axis O (FIG. 3).

This is because, by virtue of the offset position of the axis 16 with respect to the axis X—X, the axis 16 thus being closer to the point 22A than to the point 22B, the distance 21A–22B tends to increase more than the distance 21A–22A tends to decrease, which means that the strap 11 is more taut.

During this phase of pushing towards the right (arrow F2 in FIG. 3), the resistance to the unscrewing of the filter may cause the handle to pivot slightly with respect to the shoe about the axis 16, but this pivoting is limited by the tension in the strap or by the pin 18 coming back into abutment with the top end of the slots 19.

It can thus be seen that if θ represents the algebraic angle between, on the one hand, the axis Z—Z parallel to the axis X—X and passing through the axis 16 and, on the other hand, the straight line Y—Y which connects the center O of the filter to the axis 16, the positive direction being that of the force in the direction F2, (counterclockwise in the drawings), then:

during the phase of tightening the strap around the filter, θ increases, and during the pushing in the direction F2, θ tends to decrease.

Figure 4:
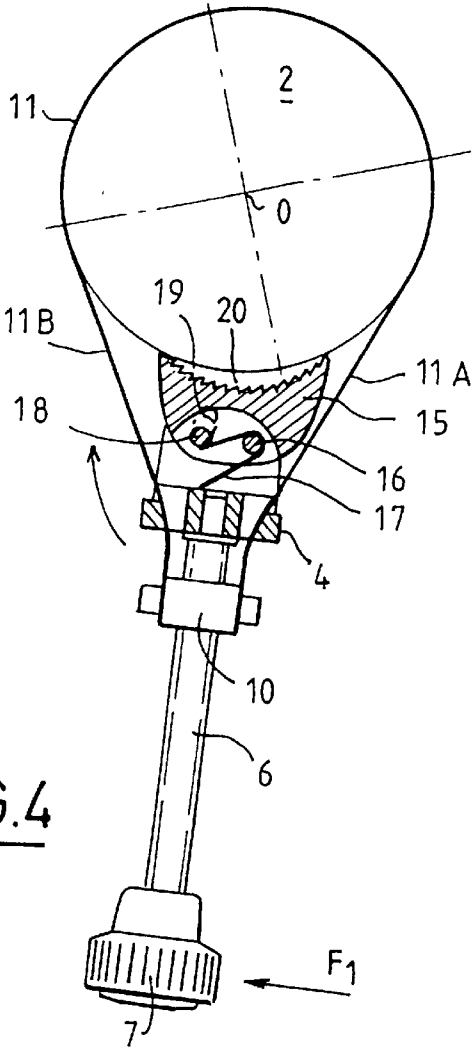
FIG. 4 is a similar view, during the subsequent phase of backing up the wrench.

After the filter has been rotated counterclockwise through a certain angle, for example limited by surrounding engine parts, the operator pushes the rod 6- knob 7 assembly in the opposite direction F1 (FIG. 4).

The distance 21B–22B tends to decrease more than the distance 21A–22A tends to increase, which means the strap 11 is less taut. Bearing in mind, in addition, the orientation of the sawteeth on the shoe, the entire tool slips about the filter 2 in the clockwise direction.

The wrench 1 therefore has a "ratchet" effect, which allows the handle to be moved back and forth a number of times to unscrew the filter 2 through several successive angles.

In the example described, the two stops for the pin 18 limit the angle θ to the range of zero to 25°. For each diameter of filter, there is a range of tightening values, and therefore a range of values of θ after tightening (FIG. 2), for which the ratchet effect is obtained. In the example in question, the amplitude of this range is about 10 to 15°. It depends on the geometry and on the coefficient of friction between the shoe and the filter.

It is important to note that as the spring 17 constantly presses the shoe against the filter, the angular offset which occurs between the shoe and the handle during the return or "ratchet back" movement is instantly taken up as soon as the action in the direction F1 stops. The tool is thus particularly ergonomic because it requires no significant twist of the wrist, after the return movement, to begin the next turning operation on the filter.

Figure 5:
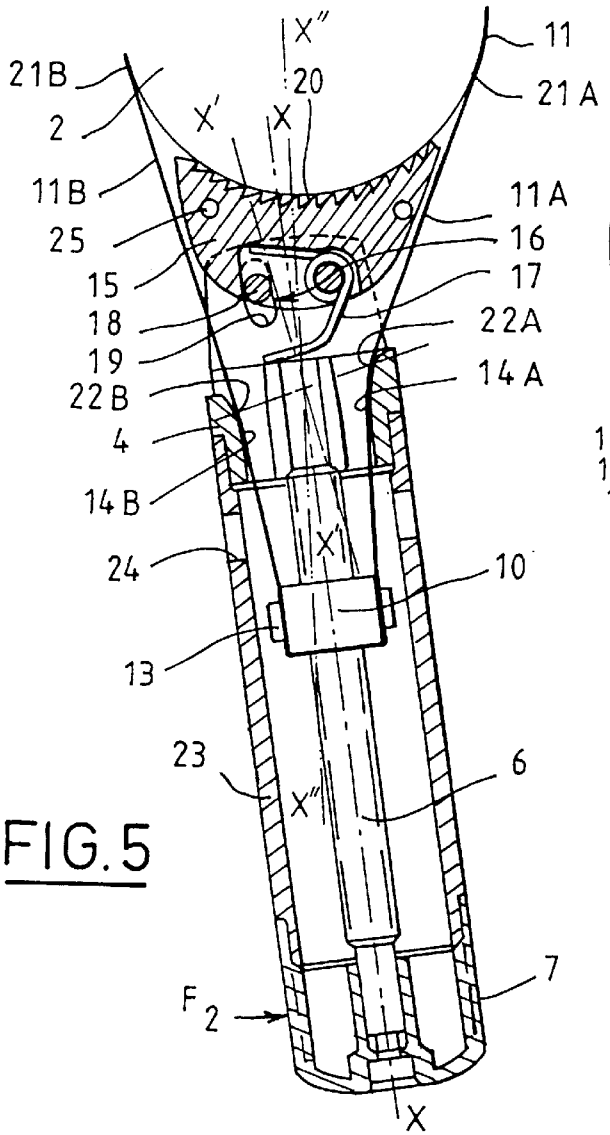
FIG. 5 depicts, in longitudinal section, another embodiment of the strap wrench according to the invention, during the first phase in the unscrewing.

In the embodiment of FIG. 5, the handle is embodied by a tubular handle body 23, for example made of plastic, especially filled with reinforcing fibers, fitted onto the base 4 at one end and onto the knob 7 at the other. The exterior surface thereof is an extension of that of the body 23.

In addition, the bearing surfaces 14 are asymmetric with respect to the axis X—X, the surface 14A on the drive side being further from the knob 7 than the opposite surface 14B. As before, the axis 16 is offset with respect to the axis X—X of the handle and is closer to the point 22A than to the point 22B irrespective of the diameter of the filter 2 in the range of diameters envisaged. In other words, the axis 16 is offset (to the right in FIG. 5) with respect to the mid-line X'—X' of the segment 22A–22B, as before. The zone 14A lies on the same side as the geometric axis 16 with respect to the straight line X'—X', and the distal end 22A is further from this straight line X'—X' than is the geometric axis 16.

In order to permit the strap to be changed, the body 23 comprises, near to the base 4, two opposed orifices 24 which allow a screwdriver to access the screws 13 when the nut 10 is in its uppermost position.

In this embodiment, the shoe 15 is made of a stack of metal sheets riveted together at 25. As an alternative, the two outermost sheets may be the two legs of a sheet bent into a U with one or more additional sheets forming spacer pieces inserted between them.

As an alternative, the surface 14A may be closer to the knob 7 than the surface 14B, provided that the axis 16 remains closer to the point 22A than to the point 22B. This has been depicted diagrammatically in FIG. 5 by a mid-line X"—X" of the segment 22A–22B which passes between the axis X—X of the handle and the axis 16.

In another particularly simple embodiment (FIG. 6), the wrench according to the invention has neither any system for adjusting the strap nor any spring. The elements which correspond to the embodiment of FIGS. 1 to 4 and whose geometry remains the same, bear the same references, increased by 100.

The wrench consists of:

- a rigid body 103 forming a handle 123, base 104 with its bearing surfaces 114 and yoke 105. This body may be molded as a single piece or may consist of two molded pieces assembled, for example by two screws, along a vertical plane of connection;
- a pin 116 borne by the yoke 105 and on which the shoe 115 is freely articulated; and
- a strap 111, at least one end part of which has a number of aligned orifices 27.

On each surface 114, the base 104 has a protruding stub 28, which can be received in an orifice 27. Each pair of orifices corresponds to a predetermined diameter of filter. In addition, a pin 118 borne by the shoe and passing through two arc-shaped slots 119 in the yoke 105 limits the angular travel of the shoe, in both directions, about the pin 116.

Such an embodiment is particularly well suited to repetitive work performed on filters which all have the same diameter.

Of course, as an alternative, the tool may be equipped with a set of straps, each having a single orifice 27 at each end, each strap corresponding to a predetermined filter diameter.

Figure 6:
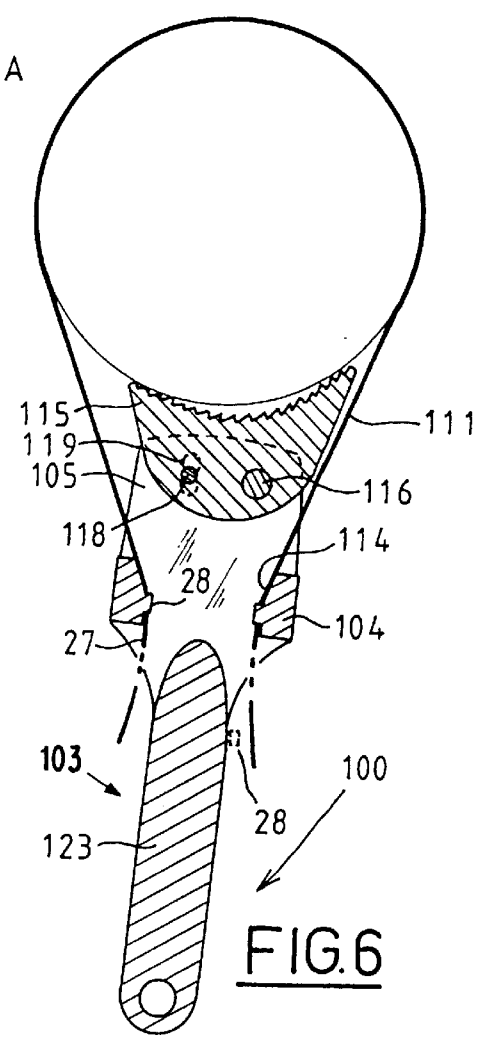
FIG. 6 is a partial view from an exploded perspective of another embodiment of the strap wrench according to the invention.

As an another alternative, at least one of the stubs 28 may be provided at the top of the handle 123, as shown in chain line in FIG. 6.

It will be understood that it is possible to add a spring 17 to this embodiment.

In another embodiment which has not been depicted, the axis of pivoting of the shoe may be purely geometric without being embodied by a pin such as 16. For that, all that is required is for the lower surface of the shoe to have a convex cylindrical shape which in cross section is in the shape of an arc of a circle and to cooperate with a mating concave guide surface provided on the body 3.

Figure 8:
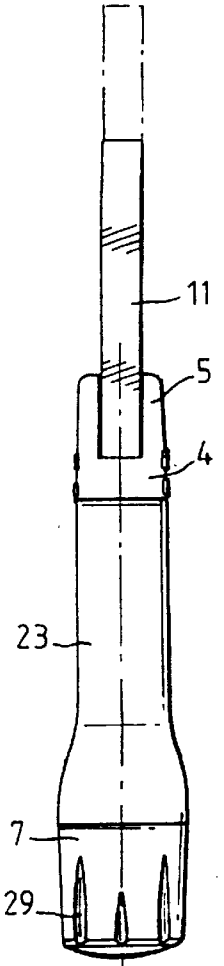
FIG. 8 is a side-on view from the outside of the same tool.
Figure 7:
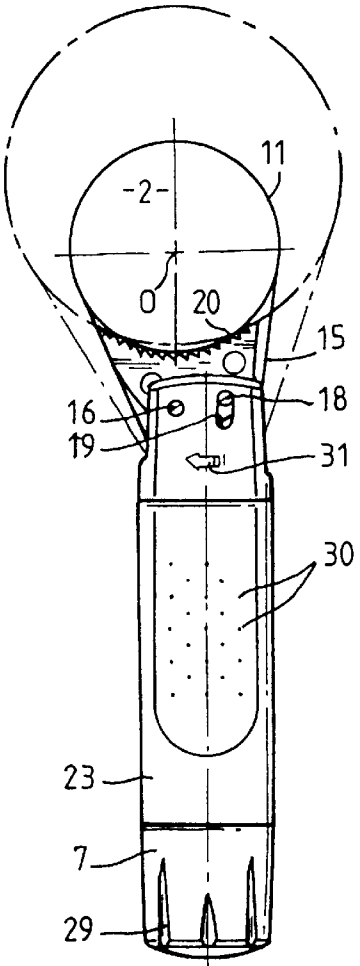
FIG. 7 is a face-on view from the outside of the strap wrench of FIG. 5.

FIGS. 7 and 8 show the external appearance of the strap wrench of FIG. 5, associated with filters of minimum and maximum diameters.

It will be observed that over its main length, the body 23 has a roughly elliptical cross section with its major axis in the overall plane of the strap. This cross section gradually becomes a circular cross section in the distal end part of the body 23, adjacent to the knob 7.

The knob 7 has flutes 29 to make it easier to grasp, and the body 23 has a number of recesses 30 and bears an arrow 31 which indicates the direction of drive. The flutes 29 allow the operator to identify the knob 7 of the body 23 unsighted, this being an effect which may be enhanced by the use of a substance which has a markedly different feel.

It will be understood that in each of the embodiments, the strap wrench according to the present invention can be used for screwing or for unscrewing, simply by turning it over.

Figure 10:
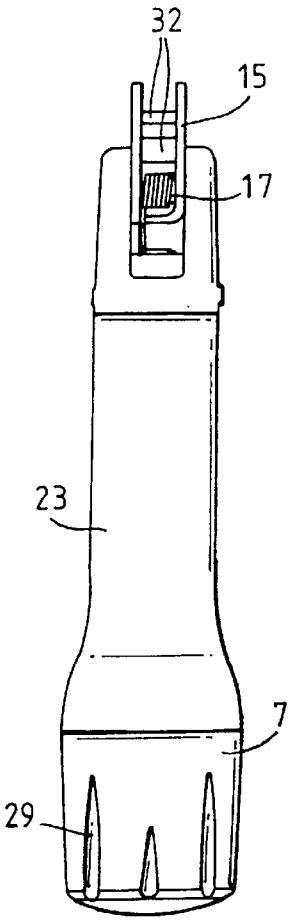
FIGS. 9 and 10 are views from the outside of an alternative form of the strap wrench of FIG. 5, the strap not being depicted.
Figure 9:
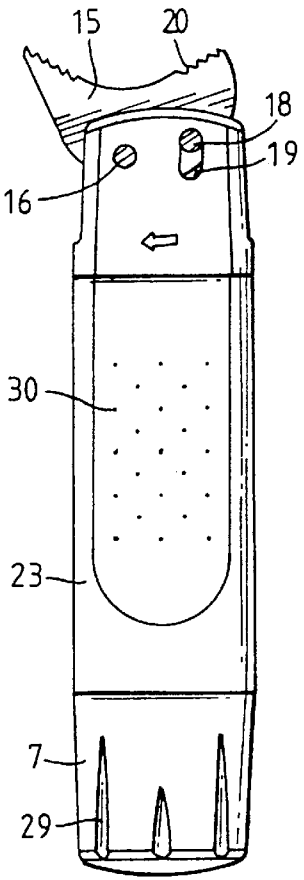

FIGS. 9 and 10 show the external appearance of a slightly modified version of the tool in which the shoe 15 has sawteeth only in its two circumferential end regions. Furthermore, this shoe is made by bending a metal sheet into the shape of a U and inserting spacer pieces 32, as described earlier.

Figure 11:
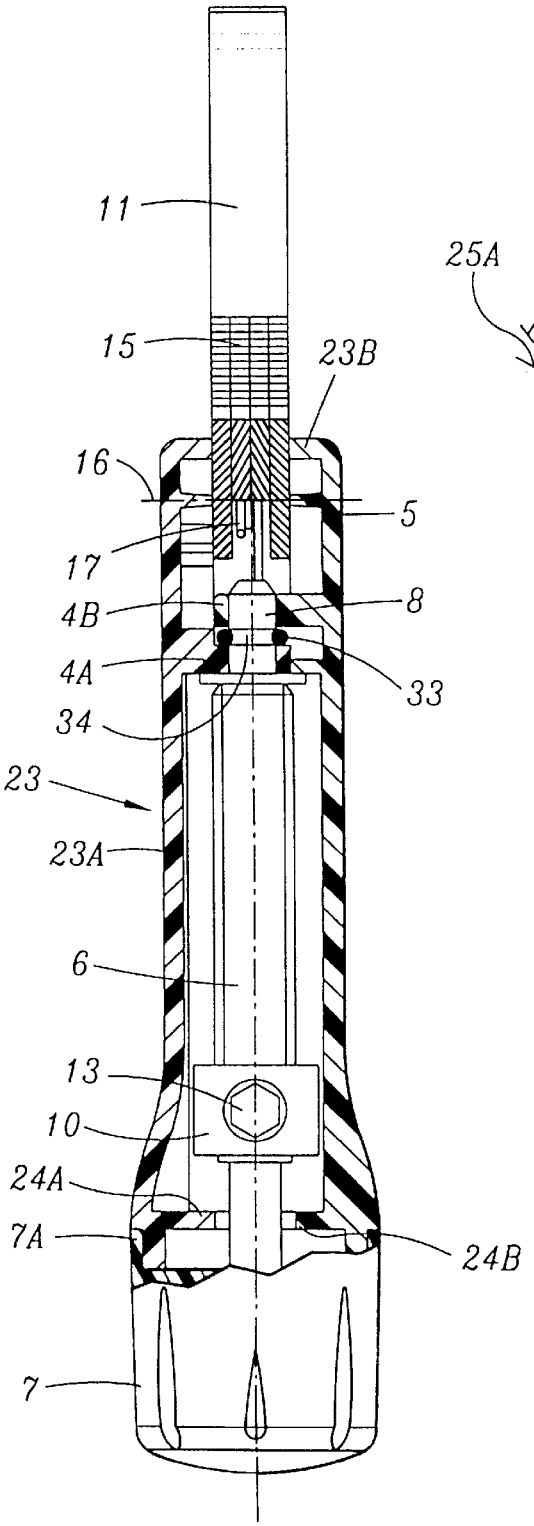
FIG. 11 is a view in longitudinal section, taken in the overall plane of the strap, of an alternative form.

FIG. 11 depicts an alternative form in which the handle body 23 consists of two half shells 23A, 23B, for example made of lightweight alloy or made of plastic, particularly filled with reinforcing fibers. The front parts of these shells together form the base 4 and the yoke 5, the base being defined by superimposed perforated respective projections 4A, 4B formed integrally with the half shells. The plain front part 8 of the rod 6 passes through the holes in these two projections and is held axially therein by a snap ring 33 located between the projections 4A and 43 and which snaps into a groove 34 in the part 8. The nut 10 is guided in its translational movement by longitudinal reliefs inside the half shells. The lower ends of the two half shells are held together by an end skirt 7A of the knob 7 pushed over them.

Dismantling may be achieved simply by pulling the knob 7 downwards, or as follows.

The knob 7 is fully unscrewed, which causes the nut 10 to move right up until it butts against the projection 4A. By continuing to unscrew, the rod 6 is pushed downwards, which parts the snap ring 33 and releases the rod. The knob-rod assembly can then be lowered, and the two half shells parted.

Likewise, assembly may be achieved either by pushing the tip of the rod directly through the projections 4A and 4B or by first of all closing the two half shells around the rod 6 and the nut 10 and then by screwing the knob 7. The nut 10 therefore moves down, butts against an internal collar 23C, 23D of the half shells, then continued screwing causes the rod 6/knob 7 assembly to rise so that the tip of the rod passes through the projections 4A and 4B. At the end of its travel, the snap ring snaps into the groove in the rod and the skirt 7A of the knob fits into position.

Figure 12:
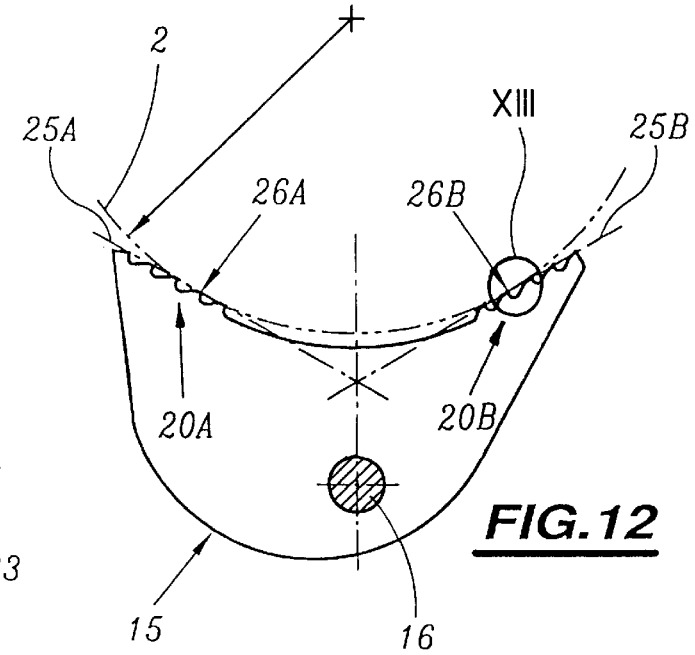
FIG. 12 depicts an alternative form of the shoe.
Figure 13:
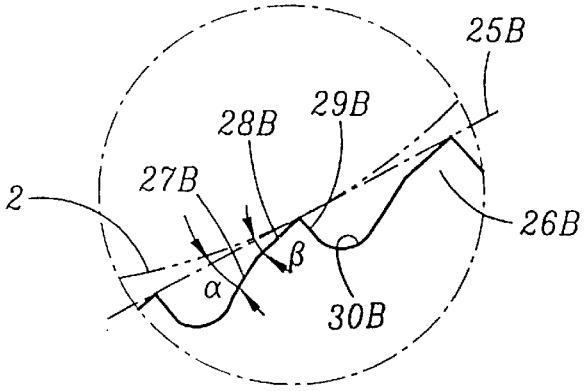
FIG. 13 is an enlarged view of detail XIII of FIG. 12.

In the alternative form of FIGS. 12 and 13, the sawteeth of the shoe 15 are distributed in two regions 20A, 20B of the bearing face 20, with clearance between them. The surfaces 25A, 25B tangential to the teeth in each of these regions may be planar as depicted, but may also be convex cylindrical or concave cylindrical with a radius larger than the largest radius of filter 2. The combination of the surfaces 25A and 25B is such that for the most common filters in the range, one tooth and one tooth alone 26A, 26B of each region is in contact with the filter.

As can be seen clearly in FIG. 13, each tooth 26A, 26B has a trapezoidal overall shape with, to the left, a surface 27A, 27B which forms, with the surface 25A, 25B a relatively large angle $\alpha$, followed by a surface 28A, 28B which forms, with the surface 25A, 25B, a relatively small angle $\beta$. The right-hand flank 29A, 29B of the tooth is almost at right angles to the surface 25A, 25B and connects to the surface 28A, 28B of the next tooth via a rounded portion 30A, 30B.

The teeth 26A, 26B are cut in two shots, i.e. a first-shot to give the overall shape of the teeth, and the second shot to cut out the part 28A, 28B of the tooth. The second cutting operation is intended to leave a tooth arris, the width of which is equal to the tolerance on the accuracy of the second cut with respect to the first.

It will be understood that in each embodiment, the strap wrench according to the invention provides one-way drive of the wrench by virtue of a toggle joint effect. The point of articulation of this toggle joint is the axis 16 or 116, one side is the segment 0–16 or 0–116, and the other side is a segment which extends from the axis 16, 116 to a point secured on the handle of the wrench, which, in the examples described, is close to the axis of the handle and to the surfaces 14, 14A–14B or 114.

What is claimed is:

1. A strap wrench for turning a generally cylindrical object, said strap wrench comprising:

a handle;

a strap in the form of a loop, said strap being arranged in a general plane and defining two opposite strap portions which extend tangentially from the object and cooperate with two zones, respectively, said zones being rigidly interconnected with said handle when said strap is wrapped tightly around the object;

a torque-transmitting shoe for pressing against and transmitting torque to the object, said shoe being connected to said handle between said two zones, wherein said shoe is not connected to said strap and has a generally cylindrical shaped bearing face, and the generatrices of said bearing face are at a right angle to the general plane of said strap, wherein said shoe is pivotally mounted with respect to said handle so that said shoe can pivot about a geometric axis that is fixed with respect to said handle and forms a right angle to the general plane of said strap, said axis being located in such a way that when said shoe and said strap are both clamped tightly against the object, operation of said handle in a first direction causes the object to be turned and operation of said handle in a second direction, which is opposite to the first direction, causes said shoe and said strap to slip on the object, and wherein said handle and said shoe comprise free travel means defining free angular travel of said handle with respect to said shoe in the first direction, when said handle is operated in the first direction, and first stop means for limiting the angular travel of said handle in the first direction.

2. A strap wrench as claimed in claim 1, wherein the clamping of the object occurs between a minimum value and a maximum value of angular travel of said handle.

3. A strap wrench as claimed in claim 1, wherein the geometric axis is laterally offset with respect to a general longitudinal axis of said handle.

4. A strap wrench as claimed in claim 3, wherein the geometric axis is located closer to the longitudinal axis of said handle than a distal end of said zone which lies on the same side of said handle as the geometric axis.

5. A strap wrench as claimed in claim 1, wherein the geometric axis is laterally offset with respect to a mid-line of a segment defined by distal ends of said two zones.

6. A strap wrench as claimed in claim 5, wherein said geometric axis is located closer to the mid-line than the distal end of said zone that lies on the same side of said handle as the geometric axis.

7. A strap wrench as claimed in claim 1, wherein said shoe is elastically biased in a specified direction about the geometric axis.

8. A strap wrench as claimed in claim 7, wherein said shoe is elastically urged in an opposite direction relative to the first direction.

9. A strap wrench as claimed in claim 1, wherein said shoe can pivot through a limited range about the geometric axis.

10. A strap wrench as claimed in claim 1, wherein said handle and said shoe comprise second stop means for limiting the pivotal movement of said handle in the second direction.

11. A strap wrench as claimed in claim 10, further comprising an adjusting device for adjusting the useful length of said strap in order to adjust the size of the loop, wherein said second stop means limits pivotal movement of said handle with respect to said shoe when said adjusting device is moved in a direction that reduces the useful length of said strap.

12. A strap wrench as claimed in claim 11, wherein said adjusting device comprises an element that is movable along said handle, and at least one end of said strap is fixed to said element.

13. A strap wrench as claimed in claim 11, wherein said shoe is pivotally mounted on a pivot pin, the axis of which constitutes the geometric axis.

14. A strap wrench as claimed in claim 1, wherein said shoe comprises a circular guiding surface shape that is adapted to cooperate with a mating member, said mating member having a circular cross sectional shape and being secured to said handle, wherein an axis of said mating member constitutes the geometric axis.

15. A strap wrench as claimed in claim 1, wherein the bearing face of said shoe has a coefficient of friction that is significantly higher in one direction of rotation of said handle than in the opposite direction of rotation of said handle.

16. A strap wrench as claimed in claim 15, wherein the bearing face of said shoe includes a plurality of inclined sawteeth.

17. A strap wrench as claimed in claim 15, wherein the bearing face includes two bearing zones which, for each object diameter belonging to a series of predetermined diameters, define two substantially pointed regions, respectively, for bearing against the surface of the object.

18. A strap wrench as claimed in claim 1, wherein said strap is formed of metal.

19. A strap wrench as claimed in claim 1, further comprising an adjusting device for adjusting the useful length of said strap in order to adjust the size of the loop.

20. A strap wrench as claimed in claim 19, wherein said adjusting device comprises an element that is movable along said handle, and at least one end of said strap is fixed to said element.

21. A strap wrench as claimed in claim 1, wherein said strap includes at least one end region having a plurality of spaced-apart attachment points adapted to be selectively fixed and removed from an attachment point formed on said handle.

22. A strap wrench as claimed in claim 1, wherein said handle and said shoe define a toggle, and an intermediate point of articulation of said toggle being the geometric axis.

23. A strap wrench for turning a generally cylindrical object in one direction, said strap wrench comprising:

a handle having a longitudinal axis;

a rigid body coupled to said handle and defining first and second contact zones on opposite sides of said handle;

a strap connected to said handle so as to form a loop for receiving the object therein, wherein opposite portions of said strap are disposed adjacent to said first and second contact zones of said rigid body, respectively; and a shoe having a bearing face for pressing against an outer peripheral surface of the object, said shoe being pivotally mounted on said rigid body so as to be capable of pivotal movement about a pivot axis that is fixed with respect to said handle, wherein said shoe is not directly connected to said strap, wherein, when said strap and said shoe are clamped tightly against the object, movement of said handle in a first direction causes the object to be rotated and movement of said handle in an opposite second direction causes said shoe and said strap to slip on the outer peripheral surface of the object, wherein said bearing face defines two bearing zones comprising teeth, each of said teeth has an overall trapezoidal shape with a point inclined in the first direction, and for each object diameter that belongs to a series of predetermined diameters, each of said bearing zones define a region for bearing against the outer peripheral surface of the object.

24. A strap wrench assembly for turning a generally cylindrical object in one direction, said strap wrench assembly comprising:

a handle having a longitudinal axis;

a rigid body coupled to said handle and defining first and second contact zones on opposite sides of said handle;

a set of straps having different lengths, each of said straps comprises, at each end, an attachment point adapted to be removably connected to a corresponding attachment point on said handle, wherein each of said straps can form a loop for receiving the object therein such that opposite portions of said strap are disposed adjacent said first and second contact zones of said rigid body, respectively; and a shoe having a bearing face for pressing against an outer peripheral surface of the object, said shoe being pivotally mounted on said rigid body so as to be capable of pivotal movement about a pivot axis that is fixed with respect to said handle, wherein said shoe is not directly connected to said strap, wherein, when said strap and said shoe are clamped tightly against the object, movement of said handle in a first direction causes the object to be rotated and movement of said handle in an opposite second direction causes said shoe and said strap to slip on the outer peripheral surface of the object.

* * * * *